US010202677B2

(12) United States Patent
Koyama et al.

(10) Patent No.: US 10,202,677 B2
(45) Date of Patent: Feb. 12, 2019

(54) PRODUCTION METHOD OF CARBURIZED STEEL COMPONENT AND CARBURIZED STEEL COMPONENT

(71) Applicant: NIPPON STEEL & SUMITOMO METAL CORPORATION, Tokyo (JP)

(72) Inventors: Tatsuya Koyama, Nishio (JP); Manabu Kubota, Nishinomiya (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 251 days.

(21) Appl. No.: 15/102,581

(22) PCT Filed: Dec. 24, 2014

(86) PCT No.: PCT/JP2014/006442
§ 371 (c)(1),
(2) Date: Jun. 8, 2016

(87) PCT Pub. No.: WO2015/098106
PCT Pub. Date: Jul. 2, 2015

(65) Prior Publication Data

US 2016/0298224 A1 Oct. 13, 2016

(30) Foreign Application Priority Data

Dec. 27, 2013 (JP) ..... 2013-273309

(51) Int. Cl.

| | |
|---|---|
| ***C23C 8/22*** | (2006.01) |
| ***C21D 1/76*** | (2006.01) |
| ***C21D 9/32*** | (2006.01) |
| ***C21D 9/40*** | (2006.01) |
| ***C21D 1/06*** | (2006.01) |
| ***C22C 38/00*** | (2006.01) |
| ***C22C 38/60*** | (2006.01) |
| ***C21D 1/74*** | (2006.01) |
| ***C23C 8/02*** | (2006.01) |
| *C22C 38/04* | (2006.01) |
| *C22C 38/06* | (2006.01) |
| *C22C 38/20* | (2006.01) |
| *C22C 38/22* | (2006.01) |
| *C22C 38/24* | (2006.01) |

(Continued)

(52) U.S. Cl.

CPC ..... *C23C 8/22* (2013.01); *C21D 1/06* (2013.01); *C21D 1/74* (2013.01); *C21D 1/76* (2013.01); *C21D 9/32* (2013.01); *C21D 9/40* (2013.01); *C22C 38/00* (2013.01); *C22C 38/60* (2013.01); *C23C 8/02* (2013.01); *C22C 38/001* (2013.01); *C22C 38/002* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/30* (2013.01); *C22C 38/32* (2013.01); *C22C 38/34* (2013.01); *C22C 38/40* (2013.01); *C22C 38/42* (2013.01); *C22C 38/44* (2013.01)

(58) Field of Classification Search

CPC ... C21D 1/06; C21D 1/74; C21D 1/76; C21D 9/32; C21D 9/40; C22C 38/00; C22C 38/001; C22C 38/002; C22C 38/04; C22C 38/06; C22C 38/20; C22C 38/22; C22C 38/24; C22C 38/26; C22C 38/28; C22C 38/30; C22C 38/32; C22C 38/34; C22C 38/40; C22C 38/42; C22C 38/44; C22C 38/60; C23C 8/02; C23C 8/22

See application file for complete search history.

(56) References Cited

U.S. PATENT DOCUMENTS 1,921,367 A * 8/1933 Mahin ..... C23C 8/00 148/225
1,926,317 A * 9/1933 Storck ..... B41L 9/10 101/132

(Continued)

FOREIGN PATENT DOCUMENTS

JP 02-156063 6/1990
JP 2787455 8/1998

(Continued)

OTHER PUBLICATIONS

Takeshi Naito et al., "On the Heat-Treatment . . . Carburizing Steel", Iron and Steel, Jun. 1, 1972, vol. 7, p. 926.

*Primary Examiner* — Jenny R Wu
(74) *Attorney, Agent, or Firm* — Clark & Brody

(57) ABSTRACT

A production method of a carburized steel, which improves a gas carburizing property of a steel having a high Si content and suppress deterioration of productivity, includes preliminary and main gas carburizing processes. In the preliminary gas carburizing process, a steel having a chemical composition that contains C, Si, Mn, and Cr and, in mass %, satisfies Formula (1) is subjected to a gas carburizing treatment at a carburizing temperature $T_p$° C. that satisfies Formula (A) for 10 minutes to less than 20 hours. In the main gas carburizing process, a gas carburizing treatment is performed at a carburizing temperature $T_r$(° C.) that satisfies Formula (B) for a carburizing time $t_r$ minutes.

$$6.5<3.5[\text{Si }\%]+[\text{Mn }\%]+3[\text{Cr }\%]\leq 18 \quad (1)$$

$$800\leq T_p<163\times\ln(CP+0.6)-41\times\ln(3.5\times[\text{Si }\%]+[\text{Mn }\%]+3\times[\text{Cr }\%])+950 \quad (A)$$

$$4<13340/(T_r+273.15)-\ln(t_r)<7 \quad (B)$$

Where, CP in the formula is substituted by a carbon potential during carburization in the preliminary carburizing process.

9 Claims, 1 Drawing Sheet

(51) Int. Cl.

| | |
|---|---|
| *C22C 38/26* | (2006.01) |
| *C22C 38/28* | (2006.01) |
| *C22C 38/30* | (2006.01) |
| *C22C 38/32* | (2006.01) |
| *C22C 38/34* | (2006.01) |
| *C22C 38/40* | (2006.01) |
| *C22C 38/42* | (2006.01) |
| *C22C 38/44* | (2006.01) |

(56) References Cited

U.S. PATENT DOCUMENTS

| | | | | |
|---|---|---|---|---|
| 3,964,737 | A * | 6/1976 | Schober | F16B 43/00 267/161 |
| 4,039,354 | A * | 8/1977 | Schober | C21D 9/02 148/226 |
| 2010/0159235 | A1* | 6/2010 | Johnston | C23C 8/20 428/332 |
| 2012/0085465 | A1* | 4/2012 | Neishi | C21D 1/06 148/211 |
| 2012/0312425 | A1* | 12/2012 | Koyama | C21D 1/06 148/217 |
| 2012/0318408 | A1* | 12/2012 | Kozawa | C21D 1/06 148/319 |

FOREIGN PATENT DOCUMENTS

| | | |
|---|---|---|
| JP | 2008-280610 | 11/2008 |
| JP | 5099276 | 12/2012 |
| JP | 2013-204645 | 10/2013 |
| WO | 2011/114836 | 9/2011 |
| WO | 2011/132722 | 10/2011 |
| WO | 2012/077705 | 6/2012 |

* cited by examiner

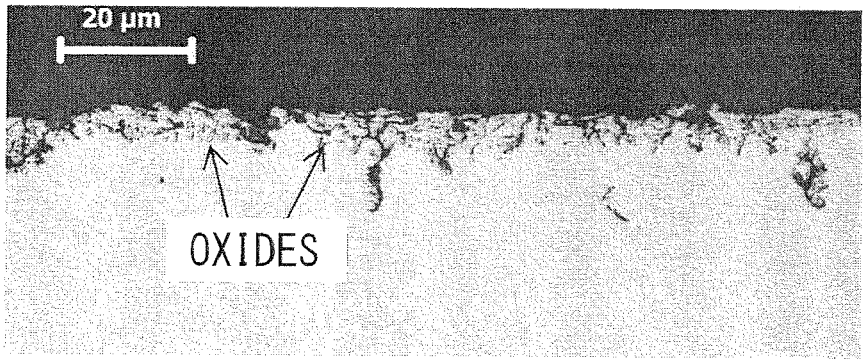
20 μm
OXIDES

PRODUCTION METHOD OF CARBURIZED STEEL COMPONENT AND CARBURIZED STEEL COMPONENT

TECHNICAL FIELD

The present invention relates to a production method of a steel component and a steel component, and more specifically to a production method of a carburized steel component by performing carburizing treatment, and a carburized steel component.

BACKGROUND ART

Steel components as represented by gears and bearings are used in severe environments and may be subjected to large loads during torque transmission and the like. Therefore, high surface fatigue strength is required for such steel components.

Steel components are generally produced in the following method. First, a starting material is foamed into a desired shape to produce an intermediate product. The intermediate product is subjected to a case hardening treatment to obtain a steel component. The casehardened steel component has high surface fatigue strength.

A method for increasing surface fatigue strength has been proposed in Japanese Patent Application Publication No. 2013-204645 (Patent Literature 1) in which a surface unevenness is formed on the surface of a steel component by pickling treatment. However, a pickling treatment is added in this method. Thus, the number of processes increases compared with an ordinary production method of a steel component. Increase in the number of processes will lead to increase in production cost.

Another method for improving surface fatigue strength is a method of increasing Si content in a steel component. Si improves hardenability of a steel component and further improves temper softening resistance in martensite. Thus, Si increases strength of a core part of the steel component and also increases surface fatigue strength.

A further method for increasing surface fatigue strength is a method of performing carburizing treatment as the casehardening treatment. Carburizing treatment foams a carburized layer on the surface of a steel component, thereby increasing surface fatigue strength of the steel component.

Japanese Patent Application Publication No. 2008-280610 (Patent Literature 2) discloses a method for producing a steel component having an increased Si content. In Patent Literature 2, a steel containing 0.5 to 3.0% of Si is subjected to a vacuum carburizing treatment. However, performing continuous treatment is difficult in such vacuum carburizing treatment. Moreover, tarring is likely to occur in vacuum carburizing treatment. Further, the properties of a steel component is difficult to control. Therefore, mass production of a steel component is difficult by means of vacuum carburizing treatment, leading to low productivity.

Another carburizing treatment different from the vacuum carburizing treatment is gas carburizing treatment. Gas carburizing treatment does not have the above described disadvantage of vacuum carburizing treatment. Therefore, gas carburizing treatment is suitable for mass production of steel components.

However, Si in steel deteriorates carburizing properties in gas carburizing treatment. For example, a casehardening steel having a chemical composition corresponding to SCr420 specified in JIS G4052 (hereafter, referred to as an ordinary casehardening steel), and a case hardening steel having a higher Si content compared to that of SCr420 (hereafter, referred to as a high-Si steel) are prepared. The ordinary casehardening steel and the high-Si steel are subjected to a gas carburizing treatment under the same condition. In this case, the depth of effective hardened layer of the high-Si steel becomes smaller than that of the ordinary casehardening steel.

It is reported in "IRON AND STEEL," 58th year (1972), Vol. 7, (Jun. 1, 1972, published by The Iron and Steel Institute of Japan), P. 926 (Non Patent Literature 1) that increase in Si content results in decrease in gas carburized depth. Therefore, there is a need for development of a production method which enables to achieve a sufficient depth of effective hardened layer even when a high-Si steel is subjected to gas carburizing treatment.

A gas carburizing method for increasing fatigue strength of a steel component is disclosed in Japanese Patent Application Publication No. 02-156063 (Patent Literature 3) and International Application Publication No. WO12/077705 (Patent Literature 4).

In Patent Literature 3, a steel material is subjected to preliminary carburization at a carburizing temperature higher than $A_1$ transformation point such that the surface carbon concentration is not less than 1.0%. Next, the steel material is gradually cooled to immediately above the $A_1$ transformation point and is soaked. Next, the steel material is reheated to a temperature less than the carburizing temperature during preliminary carburization and is quenched.

However, steel materials to be addressed in Patent Literature 3 are SCr steel, SCM steel, SNCM steel, and casehardening steels specified in JIS Standard. The Si contents of these steels are low. Therefore, when a steel having a high Si content is subjected to the gas carburizing treatment of Patent Literature 3, sufficient surface fatigue strength may not be achieved.

Patent Literature 4 discloses the following items relating to a production method including gas carburizing treatment of a high-Si steel. When a high-Si steel is subjected to an ordinary gas carburizing treatment, oxide coating is formed on the surface thereof in an early stage of the carburization. The oxide coating deteriorates gas carburizing property. Accordingly, in Patent Literature 4, the following gas carburizing treatment is performed. First, a steel material is subjected to primary carburization under an atmosphere in which oxide coating is generated. Next, the oxide coating formed on the steel material is removed by shot peening and chemical polishing, etc. Next, the steel material whose oxide coating has been removed is subjected to secondary carburization.

However, in the method of Patent Literature 4, a process of removing oxide coating is added compared to an ordinary carburizing treatment. Increase in the number of processes will lead to deterioration in productivity and increase in production cost.

CITATION LIST

Patent Literature

Patent Literature 1: Japanese Patent Application Publication No. 2013-204645

Patent Literature 2: Japanese Patent Application Publication No. 2008-280610

Patent Literature 3: Japanese Patent Application Publication No. 02-156063

Patent Literature 4: International Application Publication No. WO12/077705

Non Patent Literature

Non Patent Literature 1: "IRON AND STEEL," 58th year (1972), Vol. 7, (Jun. 1, 1972, published by The Iron and Steel Institute of Japan), P. 926.

SUMMARY OF INVENTION

It is an object of the present invention to provide a production method of a carburized steel component, which can improve gas carburizing property for a steel component having a high Si content, and suppress deterioration of productivity thereof.

The production method of a carburized steel component according to the present embodiment includes a preliminary gas carburizing process, and a main gas carburizing process. In the preliminary gas carburizing process, a steel component having a chemical composition that consists of: by mass %, C: 0.1 to 0.4%, Si: 0.7 to 4.0%, Mn: 0.2 to 3.0%, Cr: 0.5 to 5.0%, Al: 0.005 to 0.15%, S: not more than 0.3%, N: 0.003 to 0.03%, 0: not more than 0.0050%, P: not more than 0.025%, Nb: 0 to 0.3%, Ti: 0 to 0.3%, V: 0 to 0.3%, Ni: 0 to 3.0%, Cu: 0 to 3.0%, Co: 0 to 3.0%, Mo: 0 to 1.0%, W: 0 to 1.0%, B: 0 to 0.005%, Ca: 0 to 0.01%, Mg: 0 to 0.01%, Zr: 0 to 0.05%, Te: 0 to 0.1%, and rare earth metals: 0 to 0.005%, with the balance being Fe and impurities, and that satisfies Formula (1), is subjected to a gas carburizing treatment at a carburizing temperature $T_p$(° C.) that satisfies Formula (A) for 10 to less than 20 hours. The main gas carburizing process is performed following the preliminary gas carburizing process. In the main gas carburizing process, a gas carburizing treatment is performed at a carburizing temperature $T_r$(° C.) that satisfies Formula (B) for a carburizing time $t_r$ (minutes).

$$6.5<3.5[\text{Si }\%]+[\text{Mn }\%]+[\text{Cr }\%]\leq 18 \quad (1)$$

$$800\leq T_p<163\times\ln(CP+0.6)-41\times\ln(3.5\times[\text{Si }\%]+[\text{Mn }\%]+3\times[\text{Cr }\%])+950 \quad (A)$$

$$4<13340/(T_r+273.15)+\ln(t_r)<7 \quad (B)$$

Where, [Si %], [Mn %], and [Cr %] in the formulae are substituted by the Si content, Mn content, and Cr content (in mass %) in the steel component. The term ln( ) represents natural logarithm. CP is substituted by a carbon potential during carburization in the preliminary carburizing process.

The production method of the present embodiment can improve gas carburizing property for steel components having a high Si content, and also can suppress deterioration of productivity thereof.

BRIEF DESCRIPTION OF DRAWING

FIG. 1 is a cross sectional photograph of an outer layer of a carburized steel component of the present embodiment.

DESCRIPTION OF EMBODIMENTS

The present inventors have investigated and studied a method which can suppress deterioration of gas carburizing property even when the Si content in a steel component is increased.

As described above, although increase in the Si content in the steel component will lead to improvement in temper softening resistance, oxide coating is formed on the surface of the steel component during gas carburization, thereby deteriorating gas carburizing property. It is considered that the formation of oxide coating is related to alloying elements which tend to form oxides, a carburizing temperature that affects the diffusion coefficients of alloying elements and oxygen, and carbon potential that affects oxygen partial pressure.

As a result of subjecting a steel component consisting of: in mass %, C: 0.1 to 0.4%, Si: 0.7 to 4.0%, Mn: 0.2 to 3.0%, Cr: 0.5 to 5.0%, Al: 0.005 to 0.15%, S: not more than 0.3%, N: 0.003 to 0.03%, O: not more than 0.0050%, P: not more than 0.025%, Nb: 0 to 0.3%, Ti: 0 to 0.3%, V: 0 to 0.3%, Ni: 0 to 3.0%, Cu: 0 to 3.0%, Co: 0 to 3.0%, Mo: 0 to 1.0%, W: 0 to 1.0%, B: 0 to 0.005%, Ca: 0 to 0.01%, Mg: 0 to 0.01%, Zr: 0 to 0.05%, Te: 0 to 0.1%, and rare earth metals: 0 to 0.005%, with the balance being Fe and impurities, to an ordinary carburizing treatment, oxide coating was formed on the surface of the steel component. As a result of performing elemental analysis of the oxide coating by using characteristic X-rays, it is revealed that major elements contained in the oxide coating are Si, Mn, Cr, and O (oxygen).

Si, Mn, and Cr have strong affinity with oxygen, and are susceptible to oxidation. Specifically, out of the above described chemical composition, elements (for example, Ni, Cu, etc.) which have weaker affinity with oxygen than those of Si, Mn, and Cr will not be oxidized, and therefore they have no effect on the formation of oxide coating. On the other hand, since the content of elements (for example, Ti, V, etc.) which have higher affinity with oxygen than that of Si, Mn, and Cr are minute in quantity compared with the contents of Si, Mn, and Cr, they have substantially no effect on the formation of oxide coating. Thus, elements that affect the formation of oxide coating in the steel component having the above described chemical composition are Si, Mn, and Cr. Hereafter, Si, Mn, and Cr are referred to as "specific elements".

Any of the specific elements improves the strength and hardenability of steel, and also improves the temper softening resistance thereof. Therefore, when the content of these specific elements is excessively low, the surface fatigue strength of the carburized steel component decreases.

F1 is defined as follows.

$$F1=3.5\times[\text{Si }\%]+[\text{Mn }\%]+3\times[\text{Cr }\%]$$

Where, [Si %], [Mn %], and [Cr %] are substituted by the Si content, Mn content, and Cr content in the steel component.

When F1 is more than 6.5, it is possible to achieve strength and temper softening resistance required of a carburized steel component such as a gear and a bearing, and also to achieve excellent surface fatigue strength. Therefore, F1 needs to be more than 6.5 in the carburized steel component in the present embodiment.

On the other hand, as described above, each specific element forms oxide coating, thereby deteriorating gas carburizing property. Accordingly, the present inventors have further investigated the relationship between the content of specific elements and the gas carburizing property in an ordinary gas carburizing treatment by the following test method.

Various steel materials containing C: 0.1 to 0.4%, Al: 0.005 to 0.15%, S: not more than 0.3%, N: 0.003 to 0.03%, O: not more than 0.0050%, P: not more than 0.025%, and further Si: 0.1 to 4.0%, Mn: 0.1 to 3.0%, and Cr: 0.1 to 5.0% were prepared. Each steel material was subjected to hot forging and a heat treatment. Thereafter, the steel material was subjected to machining to fabricate a steel component having a prismatic shape of 20 mm×20 mm.

Each steel component was subjected to an ordinary gas carburizing treatment under the same gas carburizing condition (950° C.—carbon potential of 0.8) to fabricate a carburized steel component. The C content of the outer layer of the carburized steel component was measured by EPMA. The condition of the content of specific elements at which the C content of the outer layer to be observed becomes not less than 0.5% was determined by multiple regression analysis.

As a result of the test, it was revealed that in an ordinary gas carburizing treatment, a carburized steel component in which the C content of the outer layer was not less than 0.5% could not be obtained unless F1 was not more than 6.5. When F1 was more than 6.5, oxide coating was foamed on the surface of the steel component, and therefore the carburizing property was low, and a carburized layer was poorly formed.

However, to achieve sufficient surface fatigue strength in a carburized steel component, F1 must be more than 6.5. Accordingly, the present inventors have studied a gas carburizing treatment method by which formation of oxide coating is suppressed and sufficient gas carburizing property can be achieved even when F1 is more than 6.5. As a result, the present inventors have obtained the following findings.

Decrease in carburizing temperature suppresses formation of oxide coating. When the carburizing temperature is low, oxides become more likely to be formed not on the surface of a steel component, but within the outer layer of the steel component. That is, in this case, oxide coating is hard to be formed and, instead, oxides are formed within the outer layer. Hereafter, oxides which are foamed at a grain boundary and in a grain within the outer layer of a steel component are referred to as "internal oxides".

FIG. 1 is a cross sectional photograph of an outer layer of a carburized steel component according to the present embodiment. In FIG. 1, a large number of oxides (black spots in FIG. 1) are formed within the outer layer of the steel component. If such internal oxides are formed during gas carburizing treatment, increase in the concentration of specific elements by diffusion is suppressed in the outer layer of the steel component. For that reason, when a certain amount of internal oxides is formed, oxide coating becomes less likely to be formed in the gas carburizing treatment thereafter, and thus improving gas carburizing property.

Accordingly, the following two-stage gas carburizing process is performed as a method for suppressing formation of oxide coating even when F1 is more than 6.5. The gas carburizing process of the present embodiment includes a preliminary gas carburizing process and a main gas carburizing process which is to be performed following the preliminary gas carburizing process.

The preliminary gas carburizing process principally aims at formation of internal oxides. In the preliminary gas carburizing process, carburizing temperature is adjusted depending on the content of specific elements and carbon potential to facilitate the generation of internal oxides.

Specifically, in the preliminary gas carburizing process, gas carburizing treatment is performed at a carburizing temperature $T_p$(° C.) that satisfies Formula (A) by using a steel component having a chemical composition that satisfies the following Formula (1).

$$6.5<3.5[\text{Si }\%]+[\text{Mn }\%]+3[\text{Cr }\%]\leq 18 \quad (1)$$

$$800\leq T_p 163\times\ln(CP+0.6)-41\times\ln(3.5\times[\text{Si }\%]+[\text{Mn }\%]+3\times[\text{Cr }\%])+950 \quad (A)$$

Where, [Si %], [Mn %], and [Cr %] in the formulae are substituted by the Si content, Mn content, and Cr content (in mass %) in the steel component. The term ln( ) represents natural logarithm, and CP is substituted by a carbon potential during carburization in the preliminary gas carburizing process.

As shown in Formula (1), even if F1 is more than 6.5, when it is not more than 18, it is possible to suppress formation of oxide coating on condition that a preliminary gas carburizing treatment is performed at a carburizing temperature T that satisfies Formula (A) for 10 minutes to less than 20 hours After the preliminary gas carburizing process, the main gas carburizing process is successively performed. In the main gas carburizing process, a carburized layer is formed on the surface of the base metal of the steel component.

In the main gas carburizing process, to increase the surface fatigue strength of the carburized steel component, gas carburizing treatment is performed at a carburizing temperature $T_r$(° C.) that satisfies the following Formula (B) for a carburizing time $t_r$ (minutes).

$$4<13340/(T_r+273.15)-\ln(t_r)<7 \quad (B)$$

When the carburizing temperature $T_r$(° C.) and the carburizing time $t_r$ (minutes) satisfy Formula (B), the effective hardened layer of the carburized steel component will have an appropriate depth, and the surface fatigue strength of the carburized steel component will increase.

Preferably, the carburizing temperature $T_r$(° C.) of the main gas carburizing process is set to be higher than the carburizing temperature $T_p$(° C.) of the preliminary gas carburizing process. In the present embodiment, internal oxides are generated by the preliminary gas carburizing process that satisfies Formula (A). For that reason, the concentration of specific elements is suppressed to be low in the outer layer of the steel component during the main gas carburizing process. Therefore, even when the carburizing temperature $T_r$(° C.) is set to be higher than the carburizing temperature $T_p$(° C.) in the main gas carburizing process, oxide coating is hardly formed and thus gas carburizing property can be maintained provided that the main gas carburizing process satisfies Formula (B). As a result, even for a steel component having a high Si content, it is possible to foam a carburized layer of a sufficient thickness in a short period of time, and thus produce a carburized steel component having excellent surface fatigue strength while suppressing deterioration of productivity thereof.

A production method of a carburized steel component according to the present embodiment, which has been completed based on the above described findings, includes a preliminary gas carburizing process and a main gas carburizing process. In the preliminary gas carburizing process, a steel component having a chemical composition that consists of: by mass %, C: 0.1 to 0.4%, Si: 0.7 to 4.0%, Mn: 0.2 to 3.0%, Cr: 0.5 to 5.0%, Al: 0.005 to 0.15%, S: not more than 0.3%, N: 0.003 to 0.03%, O: not more than 0.0050%, P: not more than 0.025%, Nb: 0 to 0.3%, Ti: 0 to 0.3%, V: 0 to 0.3%, Ni: 0 to 3.0%, Cu: 0 to 3.0%, Co: 0 to 3.0%, Mo: 0 to 1.0%, W: 0 to 1.0%, B: 0 to 0.005%, Ca: 0 to 0.01%, Mg: 0 to 0.01%, Zr: 0 to 0.05%, Te: 0 to 0.1%, and rare earth metals: 0 to 0.005%, with the balance being Fe and impurities, and that satisfies Formula (1), is subjected to a gas carburizing treatment at a carburizing temperature $T_p$(° C.) that satisfies Formula (A) for 10 to less than 20 hours. The main gas carburizing process is performed following the preliminary gas carburizing process. In the main gas carburizing process, a gas carburizing treatment is performed at a carburizing temperature $T_r$(° C.) for a carburizing time $t_r$ (minutes), which satisfy Formula (B).

$$6.5<3.5[\text{Si }\%]+[\text{Mn }\%]+3[\text{Cr }\%]\leq 18 \quad (1)$$

$$800\leq T_p<163\times\ln(CP+0.6)-41\times\ln(3.5\times[\text{Si }\%]+[\text{Mn }\%]+3\times[\text{Cr }\%])+950 \quad (A)$$

$$4<13340/(T_r+273.15)-\ln(t_r)<7 \quad (B)$$

Where, [Si %], [Mn %], and [Cr %] in the formulae are substituted by the Si content, Mn content, and Cr content (in mass %) in the steel component. The term ln ( ) represents natural logarithm CP is substituted by a carbon potential during carburization in the preliminary gas carburizing process.

A carburized steel component according to the present embodiment includes: a base metal having a chemical composition that consists of, in mass %, C: 0.1 to 0.4%, Si: 0.7 to 4.0%, Mn: 0.2 to 3.0%, Cr: 0.5 to 5.0%, Al: 0.005 to 0.15%, S: not more than 0.3%, N: 0.003 to 0.03%, O: not more than 0.0050%, P: not more than 0.025%, Nb: 0 to 0.3%, Ti: 0 to 0.3%, V: 0 to 0.3%, Ni: 0 to 3.0%, Cu: 0 to 3.0%, Co: 0 to 3.0%, Mo: 0 to 1.0%, W: 0 to 1.0%, B: 0 to 0.005%, Ca: 0 to 0.01%, Mg: 0 to 0.01%, Zr: 0 to 0.05%, Te: 0 to 0.1%, and rare earth metals: 0 to 0.005%, with the balance being Fe and impurities, and that satisfies Formula (1); and a carburized layer foamed on the base metal. The C content of the outer layer of the carburized layer is not less than 0.5%, and the Si content, Mn content, and Cr content of the outer layer of the carburized layer satisfy Formula (2). The depth of effective hardened layer is 0.3 to less than 1.5 mm, and an area fraction of oxide in a depth range of 10±3 μm from the surface of the carburized layer is 7 to 50%.

$$6.5<3.5[\text{Si }\%]+[\text{Mn }\%]+3[\text{Cr }\%]\leq 18 \quad (1)$$

$$3.5[\text{Sis }\%]+[\text{Mns }\%]+3[\text{Crs }\%]\leq 9 \quad (2)$$

Where, [Si %], [Mn %], and [Cr %] in Formula (1) are substituted by the Si content, Mn content, and Cr content (in mass %) in the base metal, respectively, and [Sis %], [Mns %], and [Crs %] in Formula (2) are substituted by the Si content, Mn content, and Cr content (in mass %) of the outer layer of the carburized layer, respectively.

The above described chemical composition may contain one or more kinds selected from the group consisting of Nb: 0.02 to 0.3%, Ti: 0.02 to 0.3%, and V: 0.02 to 0.3%.

The above described chemical composition may contain one or more kinds selected from the group consisting of Ni: 0.2 to 3.0%, Cu: 0.2 to 3.0%, Co: 0.2 to 3.0%, Mo: 0.05 to 1.0%, W: 0.05 to 1.0%, and B: 0.0006 to 0.005%.

The above described chemical composition may contain one or more kinds selected from the group consisting of Ca: 0.0005 to 0.01%, Mg: 0.0005 to 0.01%, Zr: 0.0005 to 0.05%, Te: 0.0005 to 0.1%, and rare earth metals: 0.0001 to 0.005%.

Hereafter, a production method of a carburized steel component according to the present embodiment will be described. The present production method includes a preliminary gas carburizing process and a main gas carburizing process. In the preliminary gas carburizing process, oxides (internal oxides) are formed within the outer layer of a steel component having a high Si content, thereby suppressing formation of oxide coating on the surface. In the main gas carburizing process, a steel component in which formation of oxide coating is suppressed is subjected to a gas carburizing treatment at a carburizing temperature higher than that in the preliminary gas carburizing process, thereby improving productivity. Hereafter, the preliminary gas carburizing process and the main gas carburizing process will be described in detail.

[Preliminary Gas Carburizing Process]

In the preliminary gas carburizing process, a steel component having the following chemical composition is prepared. The prepared steel component is subjected to a preliminary gas carburization to generate internal oxides in steel and suppress the concentration of specific elements in the outer layer.

[Chemical Composition of Steel Component]

The chemical composition of the steel component contains the following elements. Hereafter, "%" regarding the elements represents mass %.

C: 0.1 to 0.4%

Carbon (C) increases the strength of steel. More specifically, C increases the strength of a core part of a steel component. When C content is excessively low, the above described effect cannot be effectively achieved. C content further affects the depth of effective hardened layer. On the other hand, when C content is excessively high, the toughness of steel will decrease. Therefore, C content may be 0.1 to 0.4%. The lower limit of C content is preferably 0.16%, and more preferably 0.18%. The upper limit of C content is preferably 0.30%, and more preferably 0.28%.

Si: 0.7 to 4.0%

Silicon (Si) deoxidizes steel. Si further increases the strength and hardenability of steel, and also improves temper softening resistance. Therefore, Si increases the strength of a core part of a steel component, thereby increasing surface fatigue strength. Si further forms internal oxides by satisfying the below described production conditions. Internal oxides increase the surface fatigue strength of steel. When Si content is excessively low, the above described effects cannot be effectively achieved. On the other hand, when Si content is excessively high, steel becomes susceptible to decarbonization during hot working such as hot forging. Therefore, Si content may be 0.7 to 4.0%. The lower limit of Si content is preferably 0.8%, and more preferably 1.0%. The upper limit of Si content is preferably 3.0%, and more preferably 2.5%.

Mn: 0.2 to 3.0%

Manganese (Mn) deoxidizes steel. Mn further increases the strength and hardenability of steel, and also improves temper softening resistance. Thus, Mn increases the strength of a core part of steel, as well as the surface fatigue strength thereof. Mn further combines with S in steel to form MnS, thereby making S harmless. Mn further forms internal oxides by satisfying the below described production conditions. Internal oxides increase the surface fatigue strength of steel. When Mn content is excessively low, the above described effects cannot be effectively achieved. On the other hand, when Mn content is excessively high, retained austenite remains in steel, thereby reducing strength, even when a sub-zero treatment is performed. Therefore, Mn content may be 0.2 to 3.0%. The lower limit of Mn content is preferably 0.4%, and more preferably 0.5%. The upper limit of Mn content is preferably 2.0%, and more preferably 1.5%.

Cr: 0.5 to 5.0%

Chromium (Cr) increases the strength and hardenability of steel, and also improves temper softening resistance. Thus, Cr increases the strength of a core part of a steel component, and also increases surface fatigue strength. Cr further forms internal oxides by satisfying the below described production conditions. Internal oxides increase the surface fatigue strength of steel. When Cr content is excessively low, above described effects cannot be effectively achieved. On the other hand, when Cr content is excessively high, the hardness of steel increases, thereby deteriorating cold workability. Therefore, Cr content may be 0.5 to 5.0%. The lower limit of Cr content is preferably 0.6%, and more preferably 0.8%. The upper limit of Cr content is preferably 3.0%, and more preferably 2.5%.

Al: 0.005 to 0.15%

Aluminum (Al) deoxidizes steel. Al further combines with nitrogen to form nitrides, thereby refining crystal grains. When Al content is excessively low, the above described effects cannot be effectively achieved. On the other hand, when Al content is excessively high, nitrides become coarse, thereby embrittling steel. Therefore, Al content may be 0.005 to 0.15%. The lower limit of Al content is preferably 0.01%, and more preferably 0.02%. The upper limit of Al content is preferably 0.10%, and more preferably 0.05%. Note that the above described Al content means a total Al content.

S: not more than 0.3%

Sulfur (S) is inevitably contained. Since S has an effect of increasing the machinability of steel, S may be positively contained. When S content is excessively high, the forgeability of steel deteriorates. Therefore, S content may be not more than 0.3%. To achieve the effect of improving the machinability of steel, the lower limit of S content is preferably 0.005%, and more preferably 0.01%. The upper limit of S content is preferably 0.15%, and more preferably 0.1%.

N: 0.003 to 0.03%

Nitrogen (N) combines with Al to form nitride, and refines crystal grains. When N content is excessively low, this effect cannot be effectively achieved. On the other hand, when N content is excessively high, forgeability of steel deteriorates. Therefore, N content may be 0.003 to 0.03%. The lower limit of N content is preferably 0.004%, and more preferably 0.005%. The upper limit of N content is preferably 0.025%, and more preferably 0.02%.

O: not more than 0.0050%

Oxygen (O) is an impurity. Oxygen is present in steel as oxide-based inclusions such as alumina and titania. When O content is excessively high, oxide-based inclusions become coarse. A coarse oxide-based inclusion serves as a starting point of a crack. For that reason, when the steel component is a power transmitting part, crack may develop leading to breakage. Therefore, O content may be not more than 0.0050%. O content is preferably as low as possible. O content is preferably not more than 0.0020%, and more preferably not more than 0.0015% when prolonging of service life is attempted.

P: not more than 0.025%

Phosphorous (P) is an impurity. P segregates at grain boundaries, thereby deteriorating the toughness of steel. Therefore, P content may be not more than 0.025%. P content is preferably as low as possible. P content is preferably not more than 0.020%, and more preferably not more than 0.015% when prolonging of service life of steel component is attempted.

The balance of the chemical composition of the steel component according to the present embodiment consists of Fe and impurities. Here, impurities refer to elements which are mixed in from ores and scrap as the raw materials, or production environments when steel is industrially produced, and which are tolerated within a range not adversely affecting the steel component of the present embodiment.

The chemical composition of the steel component according to the present embodiment may further contain, in place of part of Fe, one or more kinds selected from the group consisting of Nb, Ti, and V.

Nb: 0 to 0.3%

Ti: 0 to 0.3%

V: 0 to 0.3%

Any of niobium (Nb), Titanium (Ti), and vanadium (V) is an optional element and may not be contained. If contained, these elements combine with C and/or N to form carbides, nitrides, and carbonitrides, thereby refining crystal grains. However, when the contents of these elements are excessively high, the above described effect will be saturated. Further, the hot workability and machinability of steel will deteriorate. Therefore, Nb content may be 0 to 0.3%, Ti content 0 to 0.3%, and V content 0 to 0.3%.

To achieve the above described effect more effectively, the lower limit of Nb content is preferably 0.02%, the lower limit of Ti content preferably 0.02%, and the lower limit of V content preferably 0.02%. The upper limit of Nb content is preferably 0.1%, the upper limit of Ti content preferably 0.1%, and the upper limit of V content preferably 0.1%.

The chemical composition of the steel component according to the present embodiment may further contain, in place of part of Fe, one or more kinds selected from the group consisting of Ni, Cu, Co, Mo, W, and B.

Ni: 0 to 3.0%

Cu: 0 to 3.0%

Co: 0 to 3.0%

Mo: 0 to 1.0%

W: 0 to 1.0%

B: 0 to 0.005%

Any of nickel (Ni), copper (Cu), cobalt (Co), molybdenum (Mo), tungsten (W), and boron (B) is an optional element, and may not be contained. If contained, any of these elements improves the hardenability of steel. However, when the contents of these elements are excessively high, the above described effect will be saturated, and production cost will increase. Therefore, Ni content is 0 to 3.0%, Cu content is 0 to 3.0%, Co content is 0 to 3.0%, Mo content is 0 to 1.0%, W content is 0 to 1.0%, and B content is 0 to 0.005%.

To achieve the above described effect more effectively, the lower limit of Ni content is preferably 0.2%, the lower limit of Cu content preferably 0.2%, and the lower limit of Co content preferably 0.2%, the lower limit of Mo content preferably 0.05%, the lower limit of W content preferably 0.05%, and the lower limit of B content preferably 0.0006%. The upper limit of Ni content is preferably 2.0%, the upper limit of Cu content preferably 2.0%, and the upper limit of Co content preferably 2.0%, the upper limit of Mo content preferably 0.3%, the upper limit of W content preferably 0.3%, and the upper limit of B content preferably 0.001%.

The chemical composition of the steel component according to the present embodiment may further contain, in place of part of Fe, one or more kinds selected from the group consisting of Ca, Mg, Zr, Te, and rare earth metals (REM).

Ca: 0 to 0.01%

Mg: 0 to 0.01%

Zr: 0 to 0.05%

Te: 0 to 0.1%

Rare earth metals (REM): 0 to 0.005%

Any of calcium (Ca), magnesium (Mg), zirconium (Zr), tellurium (Te), and rare earth metals (REM) is an optional element, and may not be contained. If contained, these elements improve the machinability of steel.

Specifically, Ca decreases the melting point of oxides. In this case, oxides are softened by heat generated in steel material during cutting work thereof, thereby improving the machinability of steel. However, when Ca content is excessively high, a large amount of hard CaS is generated, and the machinability of steel will be rather deteriorated. Therefore, Ca content is 0 to 0.01%. To achieve the above described effect more effectively, the lower limit of C content is preferably 0.0005%.

Mg, Zr, Te, and REM control the morphology of MnS, thereby improving the machinability of steel. However, when Mg content is excessively high, MgS is generated, thereby deteriorating the machinability of steel. Therefore, Mg content is 0 to 0.01%. When Zr content is excessively high, the above described effect will be saturated. Therefore, Zr content is 0 to 0.05%. When Te content is excessively high, the above described effect will be saturated. Therefore, Te content is 0 to 0.1%. When REM content is excessively high, coarse sulfides are generated, thereby deteriorating the machinability of steel. Therefore, REM content is 0 to 0.005%.

To achieve the above described effect more effectively, the lower limit of Mg content is preferably 0.0005%, the lower limit of Zr content preferably 0.0005%, the lower limit of Te content preferably 0.0005%, and the lower limit of REM content preferably 0.0001%.

REM as used herein means a general term for 17 elements including yttrium (Y) and scandium (Sc) in addition to the elements from lanthanum (La) of atomic number 57 to lutetium (Lu) of atomic number 71 in the periodic table. The content of REM means a total content of one or more kinds of these elements.

[Formula (1)]

The chemical composition of the steel component of the present embodiment further satisfies Formula (1).

$$6.5<3.5[\text{Si }\%]+[\text{Mn }\%]+3[\text{Cr }\%]\leq 18 \quad (1)$$

Where, [Si %], [Mn %], and [Cr %] in Formula (1) are substituted by the Si content, Mn content, and Cr content (in mass %) in the steel component.

As described above, Formula (1) is an indicator relating to the content of specific elements (Si, Mn, and Cr). While the specific elements increase the surface fatigue strength of steel, they are likely to form oxide coating in a gas carburizing treatment.

When F1 (=3.5[Si %]+[Mn %]+3[Cr %]) is excessively low, the specific elements in the steel component become insufficient. For that reason, the temper softening resistance of the carburized steel component deteriorates, thereby decreasing surface fatigue strength. On the other hand, when F1 is excessively high, even if gas carburizing treatment is performed under the below described production conditions, oxide coating will be formed on the surface of the steel component, thus deteriorating gas carburizing property. When F1 is more than 6.5 to 18, the surface fatigue strength is sufficiently increased, and even if the below described gas carburizing treatment is performed, oxide coating will hardly be formed. Therefore, the gas carburizing property can also be maintained.

The above described steel component is produced, for example, by the following method. Molten steel having the above described chemical composition is produced. The molten steel is subjected to continuous casting to obtain a cast piece. The molten steel may be subjected to an ingot-making process to obtain an ingot (steel ingot). The cast piece of the ingot may be subjected to hot working to obtain a billet (steel billet) or steel bar.

The cast piece, ingot, billet, or steel bar is heated in a reheating furnace. The heated cast piece, ingot, billet, or steel bar is subjected to hot working to produce a steel component. The hot working is, for example, hot rolling or hot forging. Hot working may be performed multiple times to produce a steel component. Hot rolling and hot forging may be performed to produce a steel component.

The intermediate product after hot forging may be subjected to cold working as represented by cold forging to produce a steel component. The hot-worked and/or cold worked intermediate product may be subjected to cutting work to produce a steel component. When performing cold working to produce a steel component, the intermediate product before cold working is preferably subjected to spheroidizing annealing at 700 to 800° C. In this case, formability is improved.

[Preliminary Gas Carburizing Treatment]

The produced steel component is subjected to a preliminary gas carburizing treatment. The preliminary gas carburizing treatment is performed by using a gas carburizing furnace. After the steel component is charged into the gas carburizing furnace, gas carburizing treatment is performed at the following conditions.

[Preliminary Gas Carburizing Temperature $T_p$]

The carburizing temperature $T_p$ satisfies the following Formula (A).

$$800\leq T_p 163\times\ln(CP+0.6)-41\times\ln(3.5\times[\text{Si }\%]+[\text{Mn }\%]+3\times[\text{Cr }\%])-950 \quad (A)$$

It is defined such that FA=163×ln(CP+0.6)−41×ln(3.5×[Si %]+[Mn %]+3×[Cr %])+950. When the carburizing temperature $T_p$ is excessively higher than FA, oxygen partial pressure in the gas carburizing furnace excessively increases. Further, diffusion coefficients of specific elements and oxygen also increase. For that reason, even in a case of a steel component having a chemical composition that satisfies Formula (1), oxide coating is formed on the surface during a preliminary gas carburizing treatment. In this case, since the gas carburizing property deteriorates, a sufficient carburized layer cannot be achieved even after the next process, that is, a major gas carburizing process is performed. Which will result in decrease in the surface fatigue strength of a carburized steel component.

On the other hand, when the carburizing temperature $T_p$ is less than 800° C., carburization efficiency in the preliminary gas carburizing treatment deteriorates. In this case, the productivity decreases. Therefore, the lower limit of the carburizing temperature T is 800° C.

When the carburizing temperature $T_p$ satisfies Formula (A), internal oxides containing Si, Mn, and Cr are formed at grain boundaries and within grains within the outer layer of the steel component in the preliminary gas carburizing treatment. As a result, the concentration of specific elements within the outer layer will be suppressed. For that reason, it is possible to suppress the formation of oxide coating in the next process, that is, the main gas carburizing process.

[Carbon Potential CP]

A carbon potential CP in the preliminary gas carburizing treatment will not be particularly limited provided that the carburizing temperature $T_p$ satisfies Formula (A). The lower limit of carbon potential is preferably 0.6, and the upper limit thereof is preferably 1.2.

[Preliminary Gas Carburizing Time]

The carburizing time (preliminary gas carburizing time) at the above described carburizing temperature T is 10 minutes to less than 20 hours. When the carburizing temperature is less than 10 minutes, internal oxides will not be sufficiently generated, and the concentration of specific elements within the outer layer remains to be high. In this case, oxide coating becomes more likely to be formed in the main gas carburizing treatment. On the other hand, when the carburizing time is not less than 20 hours, the productivity decreases. Therefore, the carburizing time is 10 minutes to less than 20 hours.

[Main Gas Carburizing Process]

After the above described preliminary gas carburizing process is performed, successively, a main gas carburizing process is performed. The main gas carburizing process is performed in the same gas carburizing furnace as in the preliminary gas carburizing process. Specifically, the temperature of the gas carburizing furnace is increased after the preliminary gas carburizing process. To achieve high surface fatigue strength, it is necessary to appropriately manage the depth of effective hardened layer which is obtained from the carburizing process. For that end, the carburizing temperature $T_r$ (° C.) and the carburizing time $t_r$ (minutes) satisfy the following Formula (B).

$$4<13340/(T_r+273.15)-\ln(t_r)<7 \quad (B)$$

It is defined such that $FB=13340/(T_r+273.15)-\ln(t_r)$. When FB is excessively more than 7, the depth of effective hardened layer becomes excessively small, and the surface fatigue strength of the carburized steel component decreases. On the other hand, when FB is excessively less than 4, the depth of effective hardened layer becomes excessively large, and the surface fatigue strength of the carburized steel component decreases.

Preferably, the carburizing temperature $T_r$ of the main gas carburizing process is set to be higher than the carburizing temperature $T_p$ of the preliminary gas carburizing process. In this case, the time for gas carburizing treatment can be reduced, thereby improving the productivity. In the present embodiment, since the preliminary gas carburizing process is performed at a condition that satisfies Formula (A) to generate internal oxides, the concentration of specific elements within the outer layer of the steel component is suppressed. Owing to performing such a preliminary gas carburizing process, it is possible to achieve a sufficient depth of the effective hardened layer, thereby achieving high surface fatigue strength, even when the gas carburizing treatment is performed in a shorter period of time by raising the carburizing temperature $T_r$ during the main gas carburizing process that satisfies Formula (B).

The carbon potential in the main gas carburizing process will not be particularly limited. The carburizing treatment may be performed in a well-known range of carbon potential.

The lower limit of the carburizing temperature $T_r$ in the main gas carburizing process is preferably 820° C., and more preferably 850° C. The upper limit of the carburizing temperature $T_r$ is preferably 1050° C. Further, the lower limit of the carburizing time $t_r$ in the main gas carburizing process is preferably 20 minutes.

[Processes After Main Gas Carburizing Process]

After the above described preliminary gas carburizing process and the main gas carburizing process are performed, quenching and tempering are performed.

After the main gas carburizing process is performed, quenching treatment is performed by a well-known method. The quenching treatment is, for example, water quenching or oil quenching. After the quenching treatment is performed, tempering treatment is performed. Performing tempering treatment will increase the toughness of a product member. The tempering treatment is performed at a well-known condition.

By the above described production processes, a carburized steel component is produced. The produced carburized steel component has a sufficient depth of effective hardened layer even when its Si content is high. Therefore, the present carburized steel component has excellent surface fatigue strength. Hereafter, the carburized steel component will be described.

[Carburized Steel Component]

The carburized steel component produced by the above described production method includes a base metal and a carburized layer.

[Base Metal]

The base metal has the chemical composition of the above described steel component. That is, the chemical composition of the base metal contains the same elements as those of the above described steel component, and satisfies Formula (1).

[Carburized Layer]

The carburized layer is formed on the surface of the base metal. The C content of the outer layer of the carburized layer is not less than 0.5%. The C content of the outer layer of the carburized layer is measured by the following method. A sample having a cross section perpendicular to the surface of the carburized steel component is taken. In a region from the surface to a depth of 30 μm of a cross section (hereafter referred to as "observation face") including the surface of the carburized steel component, C concentration is measured at a pitch of 5 μm in the depth direction by using an EPMA (electron probe micro analyzer). An average of the obtained C concentrations is defined as the C content of the outer layer of the carburized steel component.

When the C content of the outer layer is less than 0.5%, the hardness of the outer layer decreases, and it is not possible to achieve excellent surface fatigue strength. The lower limit of the C content of the outer layer is preferably 0.6%, and the upper limit thereof is preferably 1.0%.

Further, the depth of effective hardened layer of the carburized steel component is 0.3 to less than 1.5 mm. The effective hardened layer is defined by a depth (mm) from the surface at which a Vickers hardness of 550 Hv is obtained. The depth of effective hardened layer is measured by the following method. In a cross section of the carburized steel component, in a region from the surface to the center, a hardness distribution is created by using a Vickers hardness meter based on JIS Z2244 (2009). In this occasion, the test force F is 1.96 N. In the obtained hardness distribution, a depth at which the Vickers hardness is 550 Hv is determined, and it is defined as an effective hardened depth (mm).

When the depth of effective hardened layer is less than 0.3 mm, it is not possible to achieve excellent surface fatigue strength. On the other hand, when the depth of effective hardened layer is not less than 1.5 mm, compressive residual stress decreases, and therefore the surface fatigue strength decreases. Therefore, the depth of effective hardened layer is 0.3 to less than 1.5 mm.

Further, Si content, Mn content, and Cr content of the outer layer of the carburized layer satisfy Formula (2).

$$3.5[\text{Si}\,\%]+[\text{Mn}\,\%]+3[\text{Cr}\,\%]\leq 9 \quad (2)$$

Where, [Si %], [Mn %], and [Cr %] in Formula (2) are substituted by the Si content, Mn content, and Cr content (in mass %) of the outer layer of the carburized layer, respectively.

The Si content, Mn content, and Cr content in the outer layer of the carburized layer are defined in the same manner as the C content of the above described outer layer. That is, in a region from the surface of the observation face of the sample to a depth of 30 μm, Si concentration, Mn concentration and Cr concentration are measured at a pitch of 5 μm in the depth direction by using an EPMA. An average of the obtained concentrations of each element is defined as the Si content, Mn content, and Cr content of the outer layer of the carburized layer, respectively.

It is defined such that F2=3.5[Sis %]+[Mns %]+3[Crs %]. Performing the preliminary gas carburizing process at the above described conditions will result in formation of internal oxides. In this case, specific elements which are dissolved in the steel component are consumed. For that reason, it is considered that the content of specific elements in the outer layer of the steel component at the start of the main gas carburizing process decreases to a level at which F2 satisfies Formula (2). Since the content of specific elements in the outer layer is suppressed, the gas carburizing property in the main gas carburizing process is maintained so that a carburized layer of a sufficient depth can be achieved. Performing the above described production method will result in that F2 satisfies Formula (2) in the outer layer of the carburized steel component (the outer layer of the gas carburized layer).

[Area Fraction of Internal Oxide]

In the carburized steel component, the area fraction of oxide (internal oxide) in a depth range of 10±3 μm from the surface of the carburized layer is 7 to 50%. Hereafter, the area fraction of oxide in a depth range of 10±3 μm from the surface of the carburized layer is referred to an "internal oxide fraction".

The internal oxide fraction is measured by the following method. An element mapping of oxygen is obtained at an interval of 0.3 μm×0.3 μm in the observation face (400 μm×400 μm) of the above described sample by using an EPMA. From which, an O concentration profile at a depth of 200 μm from the surface is extracted and binarized with a numerical value, which represents a maximum oxygen concentration in metal iron excluding the second phase thereof such as inclusions, as a threshold. Thereafter, a depth range of 10±3 μm from the surface of the carburized layer is trimmed, and out of the trimmed range, the area fraction of the region in which oxygen concentration is higher than the threshold is determined The determined area fraction is defined as an internal oxide fraction (%).

Performing the preliminary gas carburizing process and the main gas carburizing process at the above described conditions will result in an internal oxide fraction of 7 to 50%. In the preliminary gas carburizing process, when the carburizing temperature T is more than FA, the area fraction of oxide will become less than 7%. On the other hand, when the gas carburizing treatment of the present embodiment (the preliminary gas carburizing process and the main gas carburizing process) are performed, the internal oxide fraction will never be more than 50%.

Note that when a steel component whose Si content is not less than 0.7% is subjected to a conventional gas carburizing treatment, internal oxides will not be formed within crystal grains, but will be formed at grain boundaries in a small amount. Therefore, when a conventional gas carburizing treatment is performed, the internal oxide fraction will be less than 7%.

EXAMPLES

[Measurement of Depth of Effective Hardened Layer of Carburized Steel Component and Measurement of Internal Oxide Fraction]

Steel materials of Steel Nos. 1 to 34 having chemical compositions shown in Table 1 were prepared. Each steel material was subjected to hot forging and heat treatment to produce intermediate products. Each intermediate product was subjected to cutting work (machining) to produce a steel component having a prismatic shape of 20 mm×20 mm.

TABLE 1

| Steel | | Chemical composition (in mass %, the balance being Fe and impurities) | | | | | | | | | | | | |
|---|---|---|---|---|---|---|---|---|---|---|---|---|---|---|
| No. | Category | C | Si | Mn | Cr | Al | S | N | O | P | Nb | Ti | V | Ni |
| 1 | Inventive Example | 0.20 | 1.12 | 0.77 | 1.01 | 0.041 | 0.015 | 0.017 | 0.001 | 0.016 | — | — | — | — |
| 2 | Inventive Example | 0.19 | 0.71 | 0.30 | 4.56 | 0.029 | 0.030 | 0.019 | 0.002 | 0.015 | — | — | — | — |
| 3 | Inventive Example | 0.18 | 3.95 | 0.50 | 0.51 | 0.100 | 0.099 | 0.007 | 0.001 | 0.021 | — | — | — | — |
| 4 | Inventive Example | 0.11 | 2.20 | 2.94 | 0.52 | 0.030 | 0.289 | 0.011 | 0.001 | 0.017 | — | — | — | — |
| 5 | Inventive Example | 0.35 | 1.31 | 0.92 | 1.02 | 0.051 | 0.002 | 0.021 | 0.001 | 0.025 | — | — | — | — |
| 6 | Inventive Example | 0.17 | 0.75 | 0.98 | 1.01 | 0.142 | 0.008 | 0.003 | 0.001 | 0.005 | — | 0.14 | — | — |
| 7 | Inventive Example | 0.28 | 1.90 | 1.56 | 1.51 | 0.091 | 0.021 | 0.015 | 0.001 | 0.012 | — | — | 0.06 | — |
| 8 | Inventive Example | 0.18 | 1.14 | 0.95 | 1.56 | 0.006 | 0.005 | 0.029 | 0.001 | 0.005 | 0.29 | — | — | — |
| 9 | Inventive Example | 0.21 | 1.99 | 0.99 | 0.89 | 0.075 | 0.025 | 0.009 | 0.001 | 0.016 | 0.03 | — | — | — |
| 10 | Inventive Example | 0.25 | 1.67 | 1.48 | 0.76 | 0.031 | 0.009 | 0.019 | 0.001 | 0.022 | — | — | — | 2.99 |
| 11 | Inventive Example | 0.18 | 1.32 | 0.30 | 3.01 | 0.099 | 0.102 | 0.020 | 0.001 | 0.005 | — | — | — | — |
| 12 | Inventive Example | 0.23 | 1.82 | 0.41 | 2.51 | 0.006 | 0.013 | 0.014 | 0.001 | 0.024 | — | — | — | — |
| 13 | Inventive Example | 0.20 | 2.10 | 0.51 | 1.99 | 0.036 | 0.099 | 0.015 | 0.001 | 0.013 | — | — | — | 0.75 |
| 14 | Inventive Example | 0.19 | 1.89 | 0.79 | 1.51 | 0.032 | 0.051 | 0.029 | 0.001 | 0.011 | 0.04 | — | — | — |

TABLE 1-continued

| | | | | | | | | | | | | | | |
|---|---|---|---|---|---|---|---|---|---|---|---|---|---|---|
| 15 | Inventive Example | 0.19 | 1.75 | 0.50 | 0.99 | 0.026 | 0.102 | 0.015 | 0.001 | 0.012 | — | — | — | — |
| 16 | Inventive Example | 0.23 | 2.52 | 2.10 | 2.25 | 0.027 | 0.017 | 0.004 | 0.001 | 0.017 | — | 0.02 | — | — |
| 17 | Inventive Example | 0.21 | 1.01 | 1.75 | 0.90 | 0.025 | 0.015 | 0.012 | 0.001 | 0.013 | — | — | — | — |
| 18 | Inventive Example | 0.18 | 1.89 | 1.50 | 0.80 | 0.035 | 0.003 | 0.004 | 0.001 | 0.009 | — | 0.05 | — | — |
| 19 | Inventive Example | 0.25 | 1.25 | 2.00 | 1.20 | 0.033 | 0.001 | 0.011 | 0.001 | 0.015 | — | — | 0.15 | — |
| 20 | Inventive Example | 0.20 | 1.54 | 0.81 | 1.21 | 0.031 | 0.018 | 0.019 | 0.001 | 0.021 | 0.04 | — | — | 0.51 |
| 21 | Inventive Example | 0.21 | 0.97 | 1.11 | 1.02 | 0.028 | 0.018 | 0.019 | 0.001 | 0.015 | 0.03 | 0.18 | — | — |
| 22 | Inventive Example | 0.19 | 1.11 | 1.52 | 0.98 | 0.033 | 0.013 | 0.014 | 0.001 | 0.017 | — | — | — | — |
| 23 | Inventive Example | 0.19 | 0.85 | 1.21 | 1.40 | 0.031 | 0.019 | 0.021 | 0.001 | 0.010 | 0.02 | — | — | — |
| 24 | Inventive Example | 0.20 | 1.36 | 0.98 | 1.25 | 0.027 | 0.016 | 0.018 | 0.001 | 0.013 | — | — | — | — |
| 25 | Inventive Example | 0.23 | 1.21 | 0.87 | 1.39 | 0.029 | 0.014 | 0.005 | 0.001 | 0.019 | 0.02 | 0.03 | — | 1.25 |
| 26 | Inventive Example | 0.21 | 0.93 | 1.10 | 1.21 | 0.031 | 0.015 | 0.017 | 0.001 | 0.014 | — | — | — | 0.21 |
| 27 | Comparative Example | 0.03 | 0.72 | 0.75 | 1.22 | 0.035 | 0.012 | 0.025 | 0.001 | 0.014 | — | — | — | — |
| 28 | Comparative Example | 0.19 | 0.65 | 0.82 | 1.20 | 0.032 | 0.015 | 0.017 | 0.001 | 0.016 | — | — | — | — |
| 29 | Comparative Example | 0.22 | 2.68 | 2.99 | 2.01 | 0.028 | 0.020 | 0.003 | 0.001 | 0.025 | — | — | — | — |
| 30 | Comparative Example | 0.19 | 0.72 | 0.35 | 1.15 | 0.025 | 0.008 | 0.017 | 0.001 | 0.009 | — | — | — | — |
| 31 | Comparative Example | 0.20 | 1.70 | 0.79 | 1.08 | 0.031 | 0.015 | 0.017 | 0.001 | 0.016 | — | — | — | — |
| 32 | Comparative Example | 0.21 | 1.53 | 1.02 | 1.51 | 0.029 | 0.015 | 0.025 | 0.001 | 0.014 | — | — | — | — |
| 33 | Comparative Example | 0.19 | 1.75 | 0.55 | 1.60 | 0.028 | 0.020 | 0.016 | 0.001 | 0.020 | — | — | — | — |
| 34 | Comparative Example | 0.18 | 0.92 | 1.21 | 1.15 | 0.035 | 0.011 | 0.005 | 0.001 | 0.009 | — | — | — | — |

| Steel | | Chemical composition (in mass %, the balance being Fe and impurities) | | | | | | | | | |
|---|---|---|---|---|---|---|---|---|---|---|---|
| No. | Category | Cu | Co | Mo | W | B | Ca | Mg | Zr | Te | REM |
| 1 | Inventive Example | — | — | — | — | — | — | — | — | — | — |
| 2 | Inventive Example | — | — | — | — | — | — | — | — | — | — |
| 3 | Inventive Example | — | — | — | — | — | — | — | — | — | — |
| 4 | Inventive Example | — | — | — | — | — | — | — | — | — | — |
| 5 | Inventive Example | — | — | — | — | — | — | — | — | — | — |
| 6 | Inventive Example | — | — | — | — | — | — | — | — | — | — |
| 7 | Inventive Example | — | — | — | — | — | — | — | — | — | — |
| 8 | Inventive Example | — | — | — | — | — | — | — | — | — | — |
| 9 | Inventive Example | — | — | — | — | — | — | — | — | — | — |
| 10 | Inventive Example | — | — | — | — | — | — | — | — | — | — |
| 11 | Inventive Example | 1.20 | — | — | — | — | — | — | — | — | — |
| 12 | Inventive Example | — | 0.62 | — | — | — | — | — | — | — | — |
| 13 | Inventive Example | — | — | 0.39 | — | — | — | — | — | — | — |
| 14 | Inventive Example | — | — | — | 0.40 | — | — | — | — | — | — |
| 15 | Inventive Example | — | — | — | — | 0.0024 | — | — | — | — | — |
| 16 | Inventive Example | — | — | — | — | — | 0.0012 | 0.0010 | — | — | — |
| 17 | Inventive Example | — | — | — | — | — | — | — | 0.0021 | 0.0011 | — |

TABLE 1-continued

| | | | | | | | | | | | |
|---|---|---|---|---|---|---|---|---|---|---|---|
| 18 | Inventive Example | — | — | 0.12 | — | 0.0020 | — | — | — | — | 0.0031 |
| 19 | Inventive Example | — | — | 0.14 | — | — | 0.0021 | — | — | — | — |
| 20 | Inventive Example | 0.11 | — | — | — | — | — | — | — | — | — |
| 21 | Inventive Example | — | — | — | — | — | — | 0.0009 | — | — | — |
| 22 | Inventive Example | — | — | — | — | — | — | — | 0.0006 | — | — |
| 23 | Inventive Example | — | — | — | 0.07 | — | — | — | — | — | 0.0009 |
| 24 | Inventive Example | — | — | — | — | — | — | — | — | — | — |
| 25 | Inventive Example | — | — | 0.06 | — | 0.0015 | 0.0015 | — | — | — | — |
| 26 | Inventive Example | 0.17 | — | — | — | — | — | — | — | — | — |
| 27 | Comparative Example | — | — | — | — | — | — | — | — | — | — |
| 28 | Comparative Example | — | — | — | — | — | — | — | — | — | — |
| 29 | Comparative Example | — | — | — | — | — | — | — | — | — | — |
| 30 | Comparative Example | — | — | — | — | — | — | — | — | — | — |
| 31 | Comparative Example | — | — | — | — | — | — | — | — | — | — |
| 32 | Comparative Example | — | — | — | — | — | — | — | — | — | — |
| 33 | Comparative Example | — | — | — | — | — | — | — | — | — | — |
| 34 | Comparative Example | — | — | — | — | — | — | — | — | — | — |

As shown in Table 2, the steel component of each Test No. was subjected to a preliminary gas carburization and a main gas carburization under conditions shown in Table 2.

TABLE 2

| | | | Preliminary gas carburizing conditions | | | | Main gas carburizing conditions | | | |
|---|---|---|---|---|---|---|---|---|---|---|
| Test No. | Steel No. | Category | Temperature $T_p$ (° C.) | Time (min) | CP | FA | Temperature $T_r$ (° C.) | Time $t_r$ (min) | CP | FB |
| 1 | 1 | Inventive Example | 870 | 30 | 0.8 | 921 | 950 | 120 | 0.9 | 6.1 |
| 2 | 2 | Inventive Example | 890 | 42 | 0.9 | 901 | 900 | 180 | 0.7 | 6.2 |
| 3 | 3 | Inventive Example | 860 | 55 | 0.8 | 892 | 930 | 150 | 1.0 | 6.1 |
| 4 | 4 | Inventive Example | 870 | 28 | 0.7 | 890 | 950 | 100 | 1.0 | 6.3 |
| 5 | 5 | Inventive Example | 890 | 45 | 0.9 | 928 | 920 | 120 | 1.0 | 6.4 |
| 6 | 6 | Inventive Example | 850 | 10 | 0.6 | 902 | 910 | 150 | 0.9 | 6.3 |
| 7 | 7 | Inventive Example | 860 | 62 | 1.2 | 941 | 880 | 150 | 1.0 | 6.6 |
| 8 | 8 | Inventive Example | 890 | 16 | 0.8 | 912 | 900 | 200 | 0.9 | 6.1 |
| 9 | 9 | Inventive Example | 850 | 35 | 0.8 | 908 | 930 | 180 | 1.0 | 5.9 |
| 10 | 10 | Inventive Example | 880 | 38 | 0.8 | 912 | 920 | 180 | 1.1 | 6.0 |
| 11 | 11 | Inventive Example | 860 | 42 | 0.9 | 908 | 910 | 120 | 1.0 | 6.5 |
| 12 | 12 | Inventive Example | 850 | 51 | 0.7 | 884 | 890 | 150 | 0.9 | 6.5 |
| 13 | 13 | Inventive Example | 860 | 59 | 0.8 | 897 | 950 | 120 | 1.0 | 6.1 |
| 14 | 14 | Inventive Example | 880 | 34 | 0.8 | 903 | 980 | 120 | 1.0 | 5.9 |
| 15 | 15 | Inventive Example | 890 | 25 | 0.9 | 923 | 930 | 150 | 1.1 | 6.1 |

TABLE 2-continued

| Test No. | Steel No. | Category | Preliminary gas carburizing conditions Temperature $T_p$ (° C.) | Time (min) | CP | FA | Main gas carburizing conditions Temperature $T_r$ (° C.) | Time $t_r$ (min) | CP | FB |
|---|---|---|---|---|---|---|---|---|---|---|
| 16 | 16 | Inventive Example | 830 | 91 | 1.0 | 909 | 900 | 200 | 1.1 | 6.1 |
| 17 | 17 | Inventive Example | 880 | 55 | 0.8 | 920 | 950 | 120 | 0.9 | 6.1 |
| 18 | 18 | Inventive Example | 890 | 32 | 0.9 | 920 | 930 | 150 | 1.1 | 6.1 |
| 19 | 19 | Inventive Example | 850 | 29 | 0.7 | 898 | 930 | 150 | 0.9 | 6.1 |
| 20 | 20 | Inventive Example | 870 | 40 | 0.8 | 911 | 1050 | 60 | 1.0 | 6.0 |
| 21 | 21 | Inventive Example | 860 | 35 | 0.9 | 933 | 1050 | 400 | 1.0 | 4.1 |
| 22 | 22 | Inventive Example | 850 | 52 | 0.8 | 918 | 920 | 150 | 0.9 | 6.2 |
| 23 | 23 | Inventive Example | 880 | 26 | 0.8 | 918 | 940 | 120 | 0.9 | 6.2 |
| 24 | 24 | Inventive Example | 900 | 31 | 0.9 | 924 | 920 | 300 | 0.9 | 5.5 |
| 25 | 25 | Inventive Example | 870 | 35 | 0.8 | 914 | 930 | 120 | 0.9 | 6.3 |
| 26 | 26 | Inventive Example | 860 | 21 | 0.9 | 931 | 930 | 120 | 0.9 | 6.3 |
| 27 | 27 | Comparative Example | 870 | 31 | 0.8 | 925 | 950 | 100 | 0.8 | 6.3 |
| 28 | 28 | Comparative Example | 890 | 42 | 0.7 | 915 | 930 | 150 | 0.8 | 6.1 |
| 29 | 29 | Comparative Example | 870 | 25 | 0.8 | 885 | 930 | 120 | 0.9 | 6.3 |
| 30 | 30 | Comparative Example | 880 | 18 | 0.8 | 929 | 890 | 100 | 0.8 | 6.9 |
| 31 | 30 | Comparative Example | — | — | — | — | 950 | 120 | 0.8 | 6.1 |
| 32 | 6 | Comparative Example | — | — | — | — | 950 | 120 | 0.8 | 6.1 |
| 33 | 31 | Comparative Example | 890 | 8 | 0.9 | 922 | 920 | 100 | 0.8 | 6.6 |
| 34 | 32 | Comparative Example | 910 | 25 | 0.8 | 907 | 930 | 120 | 0.8 | 6.3 |
| 35 | 33 | Comparative Example | 850 | 31 | 0.8 | 920 | 850 | 20 | 0.8 | 8.9 |
| 36 | 34 | Comparative Example | 880 | 45 | 0.8 | 917 | 1030 | 550 | 1.0 | 3.9 |

For each of Test Nos. 1 to 30, and 33 to 36, the preliminary gas carburizing process was performed at conditions (carburizing temperature, carburizing time, and carbon potential CP) shown in Table 2. Further, following the preliminary gas carburizing process, the main gas carburizing process was performed at conditions (carburizing temperature, carburizing time, and CP) shown in Table 2. The steel component after the main gas carburizing process was subjected to quenching in oil at 130° C., and tempering at 150° C. to produce a carburized steel component.

For Test Nos. 31 and 32, the main gas carburizing process was performed at conditions of Table 2 without performing the preliminary gas carburizing process. After performing the main gas carburizing process, each steel component was subjected to quenching in oil at 130° C. and tempering at 150° C. By the above described processes, carburized steel components (specimens) of Test Nos. 1 to 36 were produced.

[Evaluation Test]

[Measurement of C Content and Content of Specific Elements in Outer Layer of Carburized Layer]

By the above described method, the C content, Si content, Mn content, and Cr content in the outer layer of the carburized layer of the carburized steel component of each Test No. were determined by using an EPMA. Based on the obtained Si content, Mn content, and Cr content, F2 was determined by the above described method. As the EPMA apparatus, one of a trade name JXA-8200 manufactured by JEOL (Japan Electron Optics Laboratory) Ltd was used.

[Measurement of Depth of Effective Hardened Layer and Internal Oxide Fraction]

By the above described method, the depth (mm) of effective hardened layer of each carburized steel component was determined. Further, by the above described method, the area fraction of oxide (internal oxide fraction) in a depth range of 10±3 μm from the surface of the carburized layer of the carburized steel component was determined.

[Roller Pitting Fatigue Test]

To evaluate surface fatigue strength of each produced carburized steel component, a roller pitting fatigue test was conducted by using a large roller specimen and a small roller specimen. Specifically, steel materials of Steel Nos. 1 to 34 of Table 1 were subjected to hot forging and heat treatment to produce intermediate products. The intermediate products are subjected to machining to fabricate small roller specimens and large roller specimens. The small roller specimen had a diameter of 26 mm and a width of 28 mm. The large roller specimen had a diameter of 130 mm and a width of 18 mm. The large roller specimen further had a crowning of 150 mm in the outer circumference.

In the Test Nos. 1 to 30, and 33 to 36, the fabricated small roller specimens and large roller specimens were subjected to the preliminary gas carburizing process and the main gas carburizing process at conditions shown in Table 2, and are further subjected to oil quenching at 130° C. and tempering at 150° C. In Test Nos. 31 and 32, the small roller specimens and the large roller specimens were not subjected to the preliminary gas carburizing process, but subjected to the main gas carburizing process at conditions shown in Table 2, and to oil quenching at 130° C. and tempering at 150° C.

By using the small roller specimen and the large roller specimen after tempering, the roller pitting test was performed as follows. The large roller specimen was pressed against the small roller specimen. In this occasion, the interfacial pressure was 3000 MPa in Hertzian stress. Each roller was rotated with the circumferential velocity directions of both rollers being kept in the same direction and a slip ratio therebetween being kept at −40% in a contact portion between the small roller specimen and the large roller specimen. Specifically, the circumferential velocity of the large roller specimen in the contact portion was made larger by 40% than that of the small roller specimen. The number of rotational cycles until pitting occurred in the small roller specimen was determined, and the obtained number of rotational cycles was made an evaluation indicator of the surface fatigue strength.

During the roller pitting test, the temperature of gear oil to be supplied to the contact portion was 80° C. The occurrence of pitting was detected by a vibration meter installed. After detecting vibration, the rotation of both roller specimens was stopped, and the occurrence of pitting and the number of rotational cycles were confirmed. When no pitting occurred even after the number of rotational cycles reached 10 million cycles, it was judged that the specimen had excellent surface fatigue strength, and the test was stopped at 10 million cycles.

[Test Results]

Test results are shown in Table 3.

TABLE 3

| Test No. | Steel No. | Category | F1 (mass %) | F2 (mass %) | C content of surface (mass %) | Depth of effective hardened layer (mm) | Internal oxide fraction (%) | Roller pitting fatigue test life |
|---|---|---|---|---|---|---|---|---|
| 1 | 1 | Inventive Example | 7.7 | 4.6 | 0.8 | 0.4 | 12 | Endured 10 million cycles |
| 2 | 2 | Inventive Example | 16.5 | 4.9 | 0.7 | 0.4 | 27 | Endured 10 million cycles |
| 3 | 3 | Inventive Example | 15.9 | 7.1 | 0.8 | 0.4 | 33 | Endured 10 million cycles |
| 4 | 4 | Inventive Example | 12.2 | 6.1 | 0.7 | 0.3 | 25 | Endured 10 million cycles |
| 5 | 5 | Inventive Example | 8.6 | 3.0 | 0.8 | 0.7 | 17 | Endured 10 million cycles |
| 6 | 6 | Inventive Example | 6.6 | 2.0 | 0.8 | 0.4 | 7 | Endured 10 million cycles |
| 7 | 7 | Inventive Example | 12.7 | 2.5 | 0.8 | 0.4 | 18 | Endured 10 million cycles |
| 8 | 8 | Inventive Example | 9.6 | 2.9 | 0.8 | 0.4 | 15 | Endured 10 million cycles |
| 9 | 9 | Inventive Example | 10.6 | 3.7 | 0.7 | 0.5 | 25 | Endured 10 million cycles |
| 10 | 10 | Inventive Example | 9.6 | 2.9 | 0.8 | 0.5 | 11 | Endured 10 million cycles |
| 11 | 11 | Inventive Example | 14.0 | 4.2 | 0.8 | 0.4 | 29 | Endured 10 million cycles |
| 12 | 12 | Inventive Example | 14.3 | 2.9 | 0.7 | 0.3 | 32 | Endured 10 million cycles |
| 13 | 13 | Inventive Example | 13.8 | 6.9 | 0.7 | 0.4 | 29 | Endured 10 million cycles |
| 14 | 14 | Inventive Example | 11.9 | 8.4 | 0.7 | 0.5 | 24 | Endured 10 million cycles |
| 15 | 15 | Inventive Example | 9.6 | 3.8 | 0.8 | 0.5 | 13 | Endured 10 million cycles |
| 16 | 16 | Inventive Example | 17.7 | 4.4 | 0.8 | 0.5 | 50 | Endured 10 million cycles |
| 17 | 17 | Inventive Example | 8.0 | 4.0 | 0.8 | 0.5 | 15 | Endured 10 million cycles |
| 18 | 18 | Inventive Example | 10.5 | 4.2 | 0.8 | 0.5 | 21 | Endured 10 million cycles |
| 19 | 19 | Inventive Example | 10.0 | 4.0 | 0.7 | 0.5 | 15 | Endured 10 million cycles |
| 20 | 20 | Inventive Example | 9.8 | 6.9 | 0.8 | 0.5 | 20 | Endured 10 million cycles |
| 21 | 21 | Inventive Example | 7.6 | 5.3 | 0.9 | 1.4 | 9 | Endured 10 million cycles |
| 22 | 22 | Inventive Example | 8.3 | 3.3 | 0.8 | 0.4 | 12 | Endured 10 million cycles |
| 23 | 23 | Inventive Example | 8.4 | 4.6 | 0.8 | 0.4 | 15 | Endured 10 million cycles |
| 24 | 24 | Inventive Example | 9.5 | 3.3 | 0.7 | 0.5 | 18 | Endured 10 million cycles |
| 25 | 25 | Inventive Example | 9.3 | 3.2 | 0.7 | 0.4 | 15 | Endured 10 million cycles |

TABLE 3-continued

| Test No. | Steel No. | Category | F1 (mass %) | F2 (mass %) | C content of surface (mass %) | Depth of effective hardened layer (mm) | Internal oxide fraction (%) | Roller pitting fatigue test life |
|---|---|---|---|---|---|---|---|---|
| 26 | 26 | Inventive Example | 8.0 | 2.8 | 0.8 | 0.4 | 11 | Endured 10 million cycles |
| 27 | 27 | Comparative Example | 6.9 | 3.8 | 0.8 | 0.3 | 11 | Endured 10 thousand cycles |
| 28 | 28 | Comparative Example | 6.7 | 3.0 | 0.8 | 0.4 | 11 | Endured 5.6 million cycles |
| 29 | 29 | Comparative Example | 18.4 | 12.3 | 0.2 | 0.0 | 2 | Endured 2 thousandcycles |
| 30 | 30 | Comparative Example | 6.3 | 1.3 | 0.8 | 0.3 | 8 | Endured 7.9 million cycles |
| 31 | 30 | Comparative Example | 6.3 | 3.8 | 0.8 | 0.4 | 8 | Endured 5.1 million cycles |
| 32 | 6 | Comparative Example | 6.6 | 4.0 | 0.2 | 0.0 | 4 | Endured 3 thousand cycles |
| 33 | 31 | Comparative Example | 10.0 | 9.7 | 0.6 | 0.0 | 8 | Endured 2 thousand cycles |
| 34 | 32 | Comparative Example | 10.9 | 10.6 | 0.6 | 0.0 | 5 | Endured 4 thousand cycles |
| 35 | 33 | Comparative Example | 7.9 | 0.8 | 0.7 | 0.2 | 13 | Endured 1.3 million cycles |
| 36 | 34 | Comparative Example | 8.4 | 6.7 | 1.0 | 1.6 | 17 | Endured 7.4 million cycles |

In Test Nos. 1 to 26, the chemical compositions of steel material were appropriate, and F1 satisfied Formula (1). Further, the production conditions were also appropriate, the carburizing temperature in the preliminary gas carburizing process was less than FA, and FB satisfied Formula (2). For that reason, the C content in the outer layer of the carburized layer of the carburized steel component was not less than 0.5%, and F2 satisfied Formula (2). Further, the effective hardened layer was 0.3 to less than 1.5 mm, and the internal oxide fraction was 7 to 50%. For that reason, in these Test Nos., each specimen endured 10 million cycles in the roller pitting test, exhibiting excellent surface fatigue strength. Further, the carburizing time in the gas carburizing process (the preliminary gas carburizing process and the main gas carburizing process) was less than 50 hours, and it compared favorably with an ordinary gas carburizing treatment.

On the other hand, in Test No. 27, the C content of steel material was excessively low. For that reason, in the roller pitting fatigue test, damage of the specimen occurred before the number of rotational cycles reached 10 million cycles, exhibiting low surface fatigue strength. It was considered that since the C content was excessively low, the strength of a core part, which was non-carburized layer, of the carburized steel component was low.

In Test No. 28, Si content was excessively low. For that reason, in the roller pitting fatigue test, damage of the specimen occurred before the number of rotational cycles reached 10 million cycles, thus exhibiting low surface fatigue strength. It was considered that since the Si content was excessively low, the temper softening resistance was low, and consequently the surface fatigue strength decreased.

In Test No. 29, although content of each element in steel material was appropriate, F1 was more than the upper limit of Formula (1). For that reason, the internal oxide fraction was less than 7%, the effective hardened layer was 0 mm, and the C content of the outer layer was less than 5%. As a result, the surface fatigue strength was low. It was considered that since F1 was more than the upper limit of Formula (1), the content of specific elements was excessively large, and thus oxide coating was formed on the surface of steel material in the main gas carburizing treatment.

In Test No. 30, although the content of each element in steel material was appropriate, F1 was less than the lower limit of Formula (1). For that reason, the surface fatigue strength was low. It was also considered that since the temper softening resistance was low, the surface fatigue strength decreased.

In Test No. 31, F1 was less than the lower limit of Formula (1). Further, the preliminary gas carburizing process was not performed. For that reason, the surface fatigue strength was low.

In Test No. 32, although the chemical composition was appropriate, and F1 satisfied Formula (1), the preliminary gas carburizing process was not performed. For that reason, the depth of effective hardened layer was 0 mm, and the internal oxide fraction was also low. As a result, the surface fatigue strength was low. It was considered that oxide coating was formed during the main carburizing treatment, and no carburization occurred.

In Test No. 33, although the chemical composition was appropriate, and F1 satisfied Formula (1), the carburizing time in the preliminary gas carburizing process was excessively short. For that reason, F2 did not satisfy Formula (2), and the effective hardened layer was 0 mm. As a result, the surface fatigue strength was low.

In Test No. 34, although the chemical composition was appropriate and F1 satisfied Formula (1), the carburizing temperature $T_p$ in the preliminary gas carburizing treatment was not less than FA. For that reason, F2 did not satisfy Formula (2), the effective hardened layer was 0 mm. As a result, the surface fatigue strength was low.

In Test No. 35, FB was more than the upper limit of Formula (B). For that reason, the depth of effective hardened layer was excessively low, and the surface fatigue strength decreased.

In Test No. 36, FB was less than the lower limit of Formula (B). For that reason, the depth of effective hardened layer was more than 1.5 mm, and the surface fatigue strength was low.

So far, embodiments of the present invention have been described. However, the above described embodiments are merely examples for practicing the present invention. Therefore, the present invention can be practiced by appropriately modifying the above described embodiments within a range not departing from the spirit thereof, without being limited to the above described embodiments.

INDUSTRIAL APPLICABILITY

The production method of a carburized steel component according to the present embodiment can be widely applied to the production of carburized steel components. Particularly, a carburized steel component produced by the present production method can enhance the power of automobiles, construction vehicles, industrial machines, and the like, and improve the fuel economy thereof. For that reason, the present production method is suitable for the production of carburized steel members utilized in the above described field.

The invention claimed is:

1. A production method of a carburized steel component comprising:

a preliminary gas carburizing process, wherein a steel component having a chemical composition that consists of: by mass %, C: 0.1 to 0.4%, Si: 0.7 to 4.0%, Mn: 0.2 to 3.0%, Cr: 0.5 to 5.0%, Al:

0.005 to 0.15%, S: not more than 0.3%, N: 0.003 to 0.03%, 0: not more than 0.0050%, P: not more than 0.025%, Nb: 0 to 0.3%, Ti: 0 to 0.3%, V: 0 to 0.3%, Ni: 0 to 3.0%, Cu: 0 to 3.0%, Co: 0 to 3.0%, Mo: 0 to 1.0%, W: 0 to 1.0%, B: 0 to 0.005%, Ca: 0 to 0.01%, Mg: 0 to 0.01%, Zr: 0 to 0.05%, Te: 0 to 0.1%, and rare earth metals: 0 to 0.005%, with the balance being Fe and impurities, and that satisfies Formula (1), is subjected to a gas carburizing treatment at a carburizing temperature $T_p$° C. that satisfies Formula (A) for 10 minutes to less than 20 hours; and a main gas carburizing process, wherein successively following the preliminary gas carburizing process, a gas carburizing treatment is performed at a carburizing temperature $T_r$° C. that satisfies Formula (B) for a carburizing time $t_r$ minutes, wherein the carburizing temperature $T_r$ is higher than the carburizing temperature $T_p$ $$6.5<3.5[\text{Si }\%]+[\text{Mn }\%]+[\text{Cr }\%]\leq 18 \quad (1)$$

$$800\leq T_p<163\times\ln(CP+0.6)-41\times\ln(3.5\times[\text{Si }\%]+[\text{Mn }\%]+3\times[\text{Cr }\%])+950 \quad (A)$$

$$4<13340/(T_r+273.15)+\ln(t_r)<7 \quad (B)$$

where, [Si %], [Mn %], and [Cr %] in the formulae are substituted by the Si content, Mn content, and Cr content in mass % in the steel component, the term ln( ) represents natural logarithm, and CP is substituted by a carbon potential during carburization in the preliminary gas carburizing process.

2. A carburized steel component, comprising:

a base metal having a chemical composition that consists of, by mass %,

C: 0.1 to 0.4%,
Si: 0.7 to 4.0%,
Mn: 0.2 to 3.0%,
Cr: 0.5 to 5.0%,
Al: 0.005 to 0.15%,
S: not more than 0.3%,
N: 0.003 to 0.03%,
O: not more than 0.0050%,
P: not more than 0.025%,
Nb: 0 to 0.3%,
Ti: 0 to 0.3%,
V: 0 to 0.3%,
Ni: 0 to 3.0%,
Cu: 0 to 3.0%,
Co: 0 to 3.0%,
Mo: 0 to 1.0%,
W: 0 to 1.0%,
B: 0 to 0.005%,
Ca: 0 to 0.01%,
Mg: 0 to 0.01%,
Zr: 0 to 0.05%,
Te: 0 to 0.1%, and
rare earth metals: 0 to 0.005%, with the balance being Fe and impurities, and that satisfies Formula (1); and a carburized layer formed on the base metal, wherein C content of an outer layer of the carburized layer is not less than 0.5%, Si content, Mn content, and Cr content of the outer layer of the carburized layer satisfy Formula (2), a depth of effective hardened layer is 0.3 to less than 1.5 mm, and an area fraction of oxide in a depth range of 10±3 μm from the surface of the carburized layer is 7 to 50%:

$$6.5<3.5[\text{Si }\%]+[\text{Mn }\%]+3[\text{Cr }\%]\leq 18 \quad (1)$$

$$3.5[\text{Sis }\%]+[\text{Mns }\%]+3[\text{Crs }\%]\leq 9 \quad (2)$$

where, [Si %], [Mn %], and [Cr %] in Formula (1) are substituted by the Si content, Mn content, and Cr content in mass % in the base metal, respectively, and [Sis %], [Mns %], and [Crs %] in Formula (2) are substituted by the Si content, Mn content, and Cr content in mass % of the outer layer of the carburized layer, respectively.

3. The carburized steel component according to claim 2, wherein at least one of the following element selected from the group consisting of:

Nb: 0.02 to 0.3%,
Ti: 0.02 to 0.3%, and V: 0.02 to 0.3% is present.

4. The carburized steel component according to claim 3, wherein at least one of the following element selected from the group consisting of:

Ni: 0.2 to 3.0%,
Cu: 0.2 to 3.0%,
Co: 0.2 to 3.0%,
Mo: 0.05 to 1.0,%,
W: 0.05 to 1.0%, and B: 0.0006 to 0.005% is present.

5. The carburized steel component according to claim 3, wherein at least one of the following element selected from the group consisting of:

Ca: 0.0005 to 0.01%,
Mg: 0.0005 to 0.01%,
Zr: 0.0005 to 0.05%,
Te: 0.0005 to 0.1%, and
rare earth metals: 0.0001 to 0.005% is present.

6. The carburized steel component according to claim 4, wherein at least one of the following element selected from the group consisting of:

Ca: 0.0005 to 0.01%,
Mg: 0.0005 to 0.01%,
Zr: 0.0005 to 0.05%,
Te: 0.0005 to 0.1%, and
rare earth metals: 0.0001 to 0.005% is present.

7. The carburized steel component according to claim 2, wherein at least one of the following element selected from the group consisting of:

Ni: 0.2 to 3.0%,

Cu: 0.2 to 3.0%,

Co: 0.2 to 3.0%,

Mo: 0.05 to 1.0%,

W: 0.05 to 1.0%, and B: 0.0006 to 0.005% is present.

8. The carburized steel component according to claim 4, wherein at least one of the following element selected from the group consisting of:

Ca: 0.0005 to 0.01%,

Mg: 0.0005 to 0.01%,

Zr: 0.0005 to 0.05%,

Te: 0.0005 to 0.1%, and rare earth metals: 0.0001 to 0.005% is present.

9. The carburized steel component according to claim 2, wherein at least one of the following element selected from the group consisting of:

Ca: 0.0005 to 0.01%,

Mg: 0.0005 to 0.01%,

Zr: 0.0005 to 0.05%,

Te: 0.0005 to 0.1%, and rare earth metals: 0.0001 to 0.005% is present.

* * * * *